US006129463A

United States Patent [19]

Lau et al.

[11] Patent Number: 6,129,463

[45] **Date of Patent: *Oct. 10, 2000**

[54] RIBBON TENSIONING ASSEMBLY

[75] Inventors: Ed Lau, Apopka; Mark Anthony Lombardo, Longwood; Kenneth Colonel, Oviedo, all of Fla.

[73] Assignee: Datamax Corporation, Orlando, Fla.

[ * ] Notice: This patent is subject to a terminal disclaimer.

[21] Appl. No.: 09/283,470

[22] Filed: Apr. 1, 1999

Related U.S. Application Data

[63] Continuation of application No. 09/097,253, Jun. 12, 1998, Pat. No. 5,927,875, which is a continuation of application No. 08/977,261, Nov. 24, 1997, Pat. No. 5,836,704.

[51] Int. Cl.[7] ..... B41J 33/14

[52] U.S. Cl. ..... 400/234; 400/242

[58] Field of Search ..... 400/208, 208.1, 400/234, 242, 246, 692, 618; 347/214, 217; 242/331.5, 338.1

[56] References Cited

U.S. PATENT DOCUMENTS

| | | | |
|---|---|---|---|
| 4,642,656 | 2/1987 | Shibuya et al. . | |
| 4,797,690 | 1/1989 | Takita et al. . | |
| 4,812,063 | 3/1989 | Kunimitsu et al. . | |
| 4,919,555 | 4/1990 | Kikuchi | 400/234 |
| 5,085,532 | 2/1992 | Surya et al. . | |
| 5,318,368 | 6/1994 | Fogle et al. . | |
| 5,326,182 | 7/1994 | Hagstrom . | |
| 5,370,470 | 12/1994 | Kim . | |
| 5,378,072 | 1/1995 | Gunderson . | |
| 5,478,159 | 12/1995 | Schneider et al. . | |
| 5,480,242 | 1/1996 | Gunderson . | |
| 5,496,121 | 3/1996 | Gunderson . | |
| 5,619,244 | 4/1997 | Manna . | |
| 5,622,440 | 4/1997 | Yamamoto et al. . | |
| 5,820,279 | 10/1998 | Lodwig et al. . | |

FOREIGN PATENT DOCUMENTS

| | | | |
|---|---|---|---|
| 0705708 | 4/1996 | European Pat. Off. . | |
| 0719652 | 7/1996 | European Pat. Off. . | |
| 63-130372 | 6/1988 | Japan | 400/234 |

*Primary Examiner*—Ren Yan
*Attorney, Agent, or Firm*—Dilworth & Barrese, LLP

[57] ABSTRACT

A ribbon tensioning assembly includes a knob having a top wall, an internal raised portion attached to the top wall having a first helical camming surface and a second helical camming surface out of phase and disposed about a center point. A compression helix has a first end portion forming a first helical camming surface and a second helical camming surface for engaging first and second helical camming surfaces of the knob, compression helix having a second end portion for receiving a spring. A clutch engages a surface and connects to a spring. A spindle, attaching to a ribbon supply roll, secures the knob, the compression helix, the spring and the clutch in relative position such that turning the spindle causes frictional resistance between the clutch and the surface for creating increased tension in a ribbon dispensed from the supply roll.

14 Claims, 5 Drawing Sheets

RIBBON TENSIONING ASSEMBLY

CROSS-REFERENCE TO RELATED APPLICATIONS

This application is a continuation of U.S. patent application Ser. No. 09/097,253, filed Jun. 12, 1998, now U.S. Pat. No. 5,927,875, which is a continuation of U.S. patent application Ser. No. 08/977,261, filed Nov. 24, 1997, U.S. Pat. No. 5,836,704.

BACKGROUND OF THE INVENTION

1. Field of the Invention

This disclosure relates to printers utilizing a printing ribbon and, more particularly, to a ribbon tensioning assembly to be used for tensioning the ribbon in printers.

2. Description of the Related Art

Thermal transfer printers require adequate ribbon tension to assure proper feed of the ribbon to maintain the print quality on the print media. The tension on the ribbon prevents it from developing slack which can lead to wrinkling of the ribbon. Most printers provide a torquing mechanism to provide the tension in the ribbon supply roll. This structure is configured so that the tension force acting on the ribbon is a function of the radial distance from the center of the supply hub located at the center of the supply roll to the tangent point at which the ribbon leaves the supply reel.

The problem with this structure is that the tension force tends to be lower at the beginning of the roll and higher at the end of the roll. The ribbon on a full supply roll has a larger radial distance between the center of the roll and the tangent point at which the ribbon leaves the roll. Since torque remains substantially constant and the radius is relatively large, the tension force is small. As the ribbon is fed off the supply roll, the radius decreases resulting in an increased tension force in the ribbon.

Depending on the type of print media, it is desirable to sometimes use a ribbon of a different width. Wrinkling of ribbon is less of a problem for narrow width ribbons. Therefore, the tension force required is less for narrower ribbons and greater for wider ribbons. It would be advantageous to be able to adjust the tension of the ribbon to account for varied widths of ribbon.

Thus, a need exists for a ribbon tensioning assembly that provides an adjustable constant tension force to the ribbon regardless of the amount of ribbon on the ribbon supply roll. A need also exists for a ribbon tension adjustment in which tension can be varied to the ribbon based on the width of ribbon used. A need also exists for providing different tensions for various media and ribbon combinations.

SUMMARY OF THE INVENTION

A ribbon tensioning assembly includes a knob having a top wall, an internal raised portion attached to the top wall having a first helical camming surface and a second helical camming surface out of phase and disposed about a center point.

A compression helix has a first end portion forming a first helical camming surface and a second helical camming surface for engaging first and second helical camming surfaces of the knob, compression helix having a second end portion for receiving a spring. A clutch engages a surface and connects to a spring. A spindle, attached to a ribbon supply roll, secures the knob, the compression helix, the spring and the clutch in relative position such that turning the spindle causes frictional resistance between the clutch and the surface for creating increased tension in a ribbon dispensed from the supply roll.

A method of tensioning ribbon for a printer includes the step of providing a knob having a top wall, an internal raised portion attached to the top wall having a first helical camming surface and a second helical camming surface out of phase and disposed about a center point, a compression helix having a first end portion forming a first helical camming surface and a second helical camming surface for engaging first and second helical camming surfaces of the knob, compression helix having a second end portion for receiving a spring, a clutch for engaging a surface, the clutch connecting to a spring and a spindle, attaching to a ribbon supply roll, for securing the knob, the compression helix, the spring and the clutch in relative position such that turning the spindle causes frictional resistance between the clutch and the surface for creating increased tension in a ribbon dispensed from the supply roll. The steps further include evaluating the ribbon width to be used, adjusting the knob to compress the spring in accordance with the ribbon width and driving the supply roll during printing such that ribbon wrinkling and misfeed are minimized.

BRIEF DESCRIPTION OF DRAWINGS

The invention will be described in detail in the following description of preferred embodiments with reference to the following figures wherein.

DETAILED DESCRIPTION OF PREFERRED EMBODIMENTS

The present disclosure describes a ribbon tensioning assembly for use with a printer. The ribbon tensioning device provides a constant tension force to the ribbon by placing a compressive force on the end of a ribbon supply roll which creates a constant frictional force between the supply roll and a rewind disc. A knob is used to adjust the amount of compressive force applied to the supply roll thereby increasing or decreasing the normal force. Since the frictional force is providing the tension, an increased normal force increases the frictional force. A pair of helical camming surfaces are used to deflect the spring to a predetermined displacement thereby applying the desired forced to the supply roll and tensioning the ribbon. The force is maintained while the supply roll is allowed to rotate. This is accomplished by providing a slip clutch on the ribbon tensioning assembly which allows rotation while maintaining the frictional force.

Figure 1:
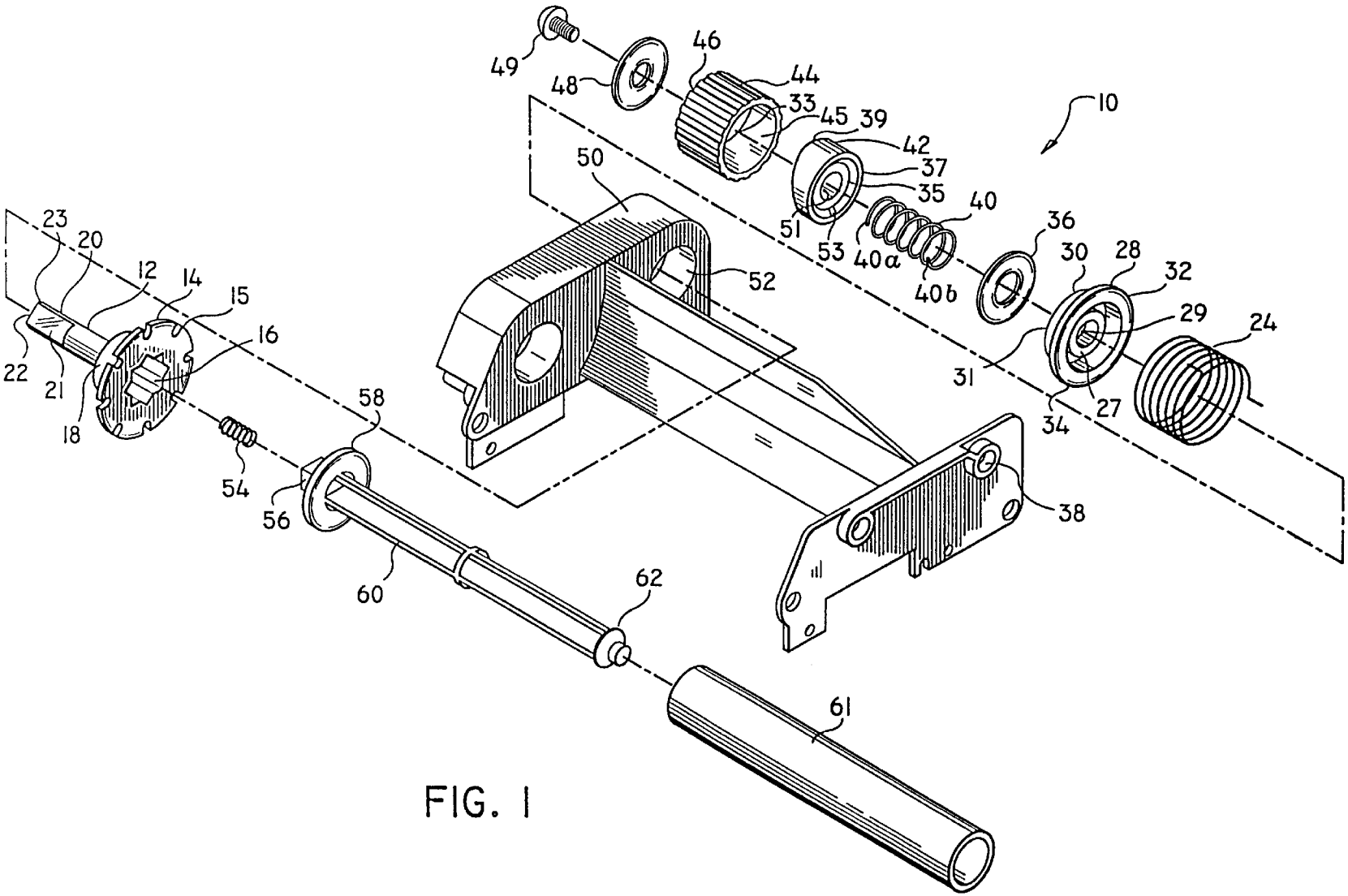
FIG. 1 is an exploded view of a ribbon tensioning assembly in accordance with one preferred embodiment of the present invention.

Referring now in specific detail to the drawings in which like reference numerals identify similar or identical elements throughout the several views, and initially to FIG. 1, one embodiment of a ribbon tensioning assembly constructed in accordance with the present disclosure is shown generally as ribbon tensioning assembly 10.

Ribbon tensioning assembly 10 includes a ribbon spindle 12 defining a longitudinal cavity 16 therein. A first end portion 14 of the ribbon spindle 12 has a flanged end 15 for engaging a mounting plate 50. Ribbon spindle 12 further includes a second end portion 20 which extends from the first end portion 14. Second end portion 20 is substantially cylindrical and extends along the longitudinal axis of the spindle 12. Second end 20 portion defines a threaded hole 22 at an end 23 and further includes a flat 21 extending longitudinally to an intermediate point on the spindle 12. First end portion 14 of spindle 12 has a cylindrical section 18 having a larger radius than second end portion 20. Spindle 12 passes through a bore 52 in plate 50. Cylindrical section 18 of spindle 12 engages bore 52 to allow spindle 12 to rotate therein.

Rewind disc 28 defines a bore 29 therethrough and has a first end portion 30 having a surfaced end 31. A second end portion 32 of rewind disc 28 has a flanged end 34 and raised interior surface 27. Raised interior surface 27 engages a portion of cylindrical section 18 of spindle 12 as it exits from plate 50. A torsion spring 24 is secured between plate 50 and flanged end 34 of rewind disc 28.

Figure 4:
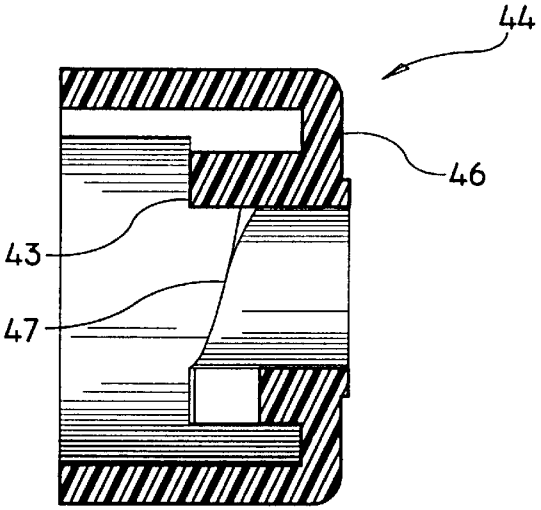
FIG. 4 is a section view as defined in FIG. 3 of the knob showing the helical camming surfaces.
Figure 6:
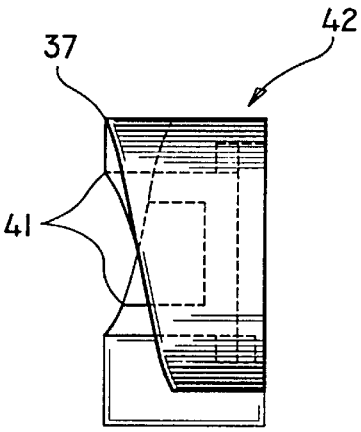
FIG. 6 is a side view of the compression helix showing the helical camming surfaces.
Figure 3:
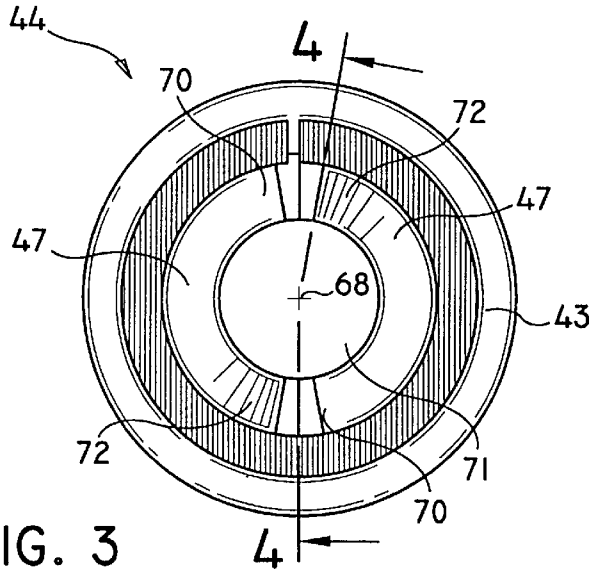
FIG. 3 is an end view of the knob of the ribbon tensioning assembly of FIG. 2 showing the helical camming surfaces.
Figure 5:
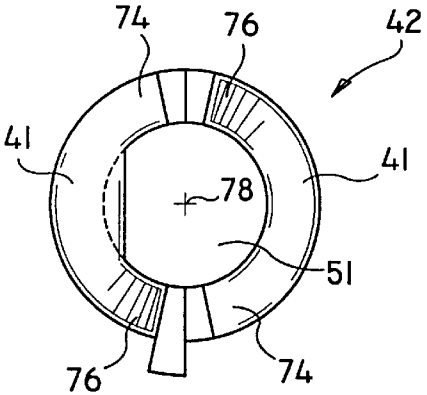
FIG. 5 is an top view of the compression helix showing the helical camming surfaces.

A knob 44 defines a cavity 45 therein and a bore 33 therethrough. A top wall 46 of knob 44 has a interior raised portion 43 (FIGS. 3 and 4). Interior raised portion 43 of top wall 46 forms two helical camming surfaces 47 which are shown in FIGS. 3 and 4 and will described in detail below. Cavity 45 receives compression helix 42 therein. Compression helix 42 has two helical camming surfaces 41 formed on a first end portion 39. Helical camming surfaces 41, as shown in FIGS. 5 and 6, correspond to helical camming surfaces 47 and abut allowing the surfaces to slide against one another as knob 44 is rotated during operation. Compression helix 42 has a second end portion 37 defining a recessed portion 35 to receive a compression spring 40. Compression spring 40 has ends 40*a* and 40*b*. End 40*a* is secured within recessed portion 35, and end 40*b* engages a slip clutch washer 36.

Slip clutch washer 36 has a step or bump 59 (FIG. 2) formed thereon to prevent rotation relative to compression spring 40 during operation. Similarly, recessed portion 35 has a step or bump 53 formed thereon to engage end 40*a* of compression spring 40 to prevent rotation relative to compression helix 42 during operation.

Assembly 10 is secured together through plate 50 by second end portion 20 of spindle 12 which passes through torsional spring 24, bore 29 of rewind disc 28, slip clutch washer 36, compression spring 40 and a D-shaped hole 51 of compression helix 42. Knob cavity 45 is placed over compression helix 42 allowing the engagement of helical camming surfaces 41 and 47, and secured by a screw 49 and washer 48. D-shaped hole 51 mounts on flat 21 of second end portion 20 of spindle 12. This prevents relative motion between compression helix 42 and spindle 12.

Cavity 16 of spindle 12 is formed to receive a skewer 60. Skewer 60 has a keyed end portion 56 with a flange 58 formed thereon. Keyed end portion 56 fits within cavity 16 of spindle 12. A compression spring 54 is placed within cavity 16 between keyed end portion 56 and spindle 12 to preload skewer 60 and maintain a skewer end 62 in place. When it is necessary to install or remove ribbon, a supply roll of ribbon (not shown) is placed on supply hub 61, compression spring 54 is deflected to release end 62 from hole 38. Skewer 60 can now be removed and supply hub 61 installed with supply roll thereon.

Figure 2:
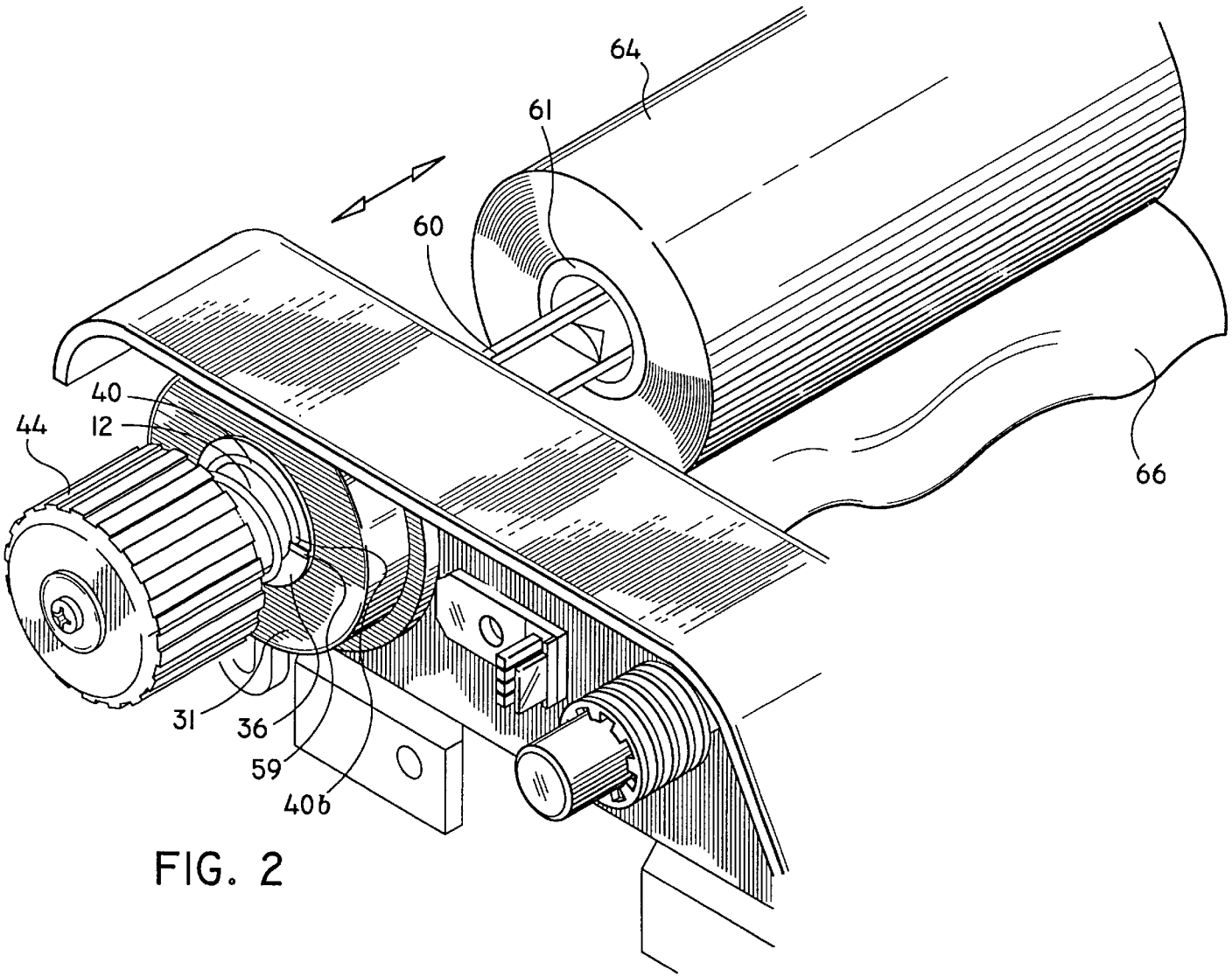
FIG. 2 is an isometric view of the assembled ribbon tensioning assembly of FIG. 1.

Referring now to FIGS. 1 and 2, during operation skewer 60, supply roll 64 and spindle 12 rotate together during operation. Ribbon 66 is drawn from supply roll 64. Drawing ribbon 66 causes supply roll 64, skewer 60 and spindle 12 to rotate. In order to maintain a desired amount of tension within the ribbon 66, to prevent it from wrinkling and to allow proper feeding, a motion resistive force is applied to counter the motion of the supply roll 64. As spindle 12 rotates torsional spring 24 (FIG. 1) deflects slightly until equilibrium is reestablished. This allows supply roll to be underdriven to aid in preventing wrinkles in ribbon 66. When equilibrium is reestablished in torsional spring 24, spindle 12 continues to rotate and slipping occurs between surfaced end 31 of rewind disc 28 and slip clutch washer 36. The frictional force between slip clutch washer 36 and surfaced end 31 provides the motion resistive force to counter the motion of supply roll 64.

The frictional force between surfaced end 31 and slip clutch washer 36 can be adjusted by compression spring 40. Knob 44 is rotated such that helical camming surfaces 47 engage helical camming surfaces 41 shown in FIGS. 3 and 5, respectively. As knob 44 is turned compression helix 42 is displaced compressing compression spring 40. The deflection of compression spring 40 creates an increased normal force on slip clutch washer 36 thereby increasing the amount of friction required to turn supply roll 64. Compression helix 42 rotates with spindle 12 due to the engagement of D-shaped hole 51 and flat 21. In order to ensure no movement between the slip clutch washer 36 and compression spring 40, end 40*b* engages step 59 on slip clutch washer 36 and prevents rotation. Therefore, knob 44, compression spring 40, compression helix 42, slip clutch washer 36, skewer 60 and supply roll 64 all rotate with spindle 12.

The relative motion between rewind disc 28 and slip clutch washer 36 provides the frictional engagement needed to resist motion of the supply roll 64 thereby supplying a constant tension to ribbon 66. Wider ribbons require more tension in order to prevent ribbon misfeed or wrinkling. Knob 44 can be adjusted to increase or decrease tension for use with ribbons of varying widths by increasing the deflection of compression spring 40 to increase the frictional force between the slip clutch washer 36 and the rewind disc 28.

Referring to FIGS. 3 and 4, knob 44 includes internal raised portion 43 having helical camming surfaces 47. Each helical camming surface has a low point 70 and a high point 72 defining a right hand helix disposed about a center point 68. Each helix is 180 degrees out of phase with the other, i.e. where one helix begins at high point 72 the other begins at low point 70. Internal raised portion 43 and top wall 46 have a bore 71 formed therethrough. At each high point 72 a helix with opposite orientation exists to keep knob 44 and compression helix 42 in a stable position.

Referring to FIGS. 5 and 6, compression helix 42 has helical camming surfaces formed on second end portion 37. Each helical camming surface has a low point 74 and a high point 76 defining a right hand helix disposed about a center point 78. Each helix is 180 degrees out of phase with the other, i.e. where one helix begins at high point 76 the other begins at low point 74. D-shaped hole 51 is formed through compression helix 42. Further, the helical camming surfaces 41 engage helical camming surfaces 47 and are maintained in relative position by second end portion 20 of spindle 12, compression spring 40 and screw 49. Screw 49 passes through washer 48, bore 33 and D-shaped hole 51 to engage threaded hole 22.

Figure 7:
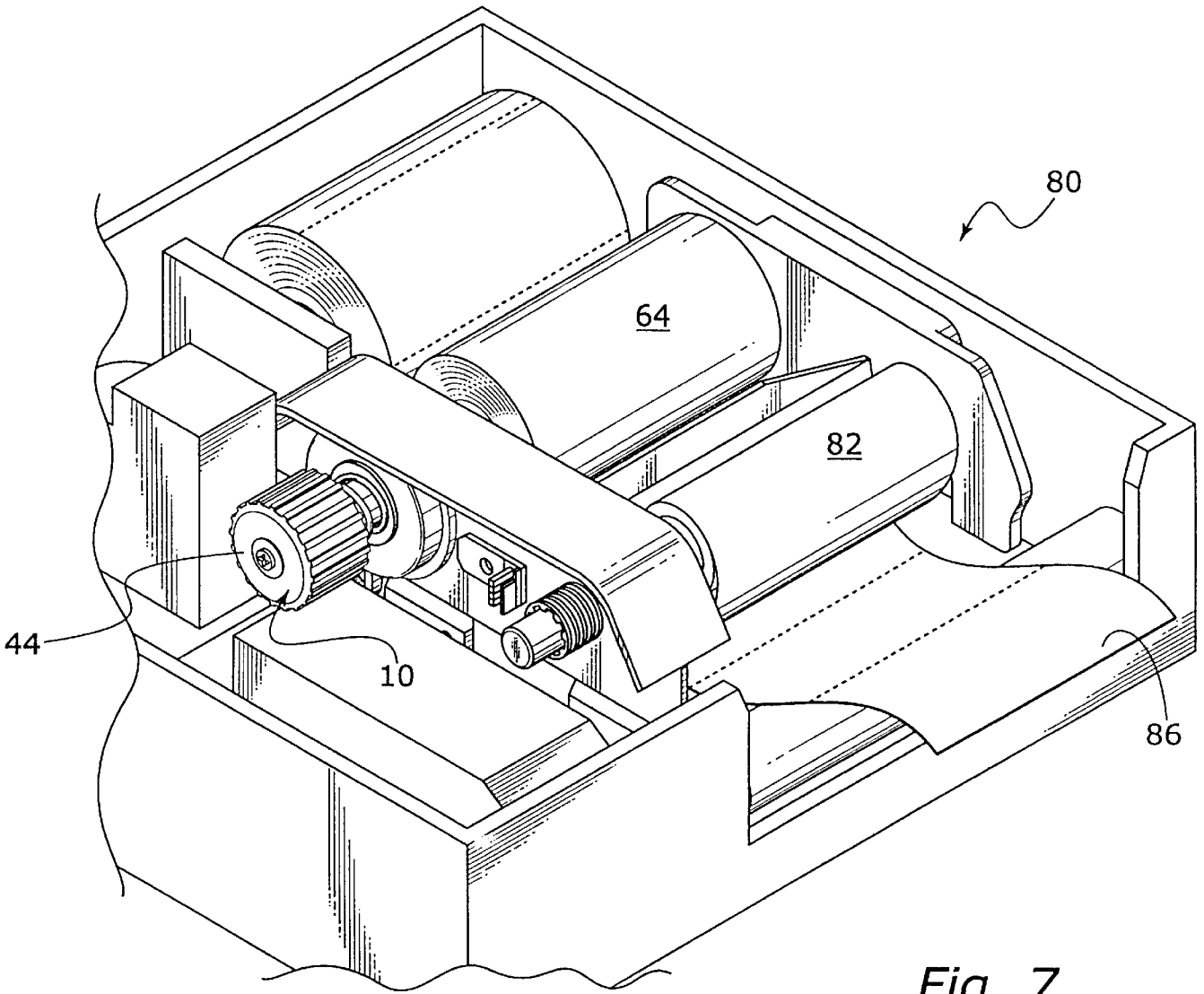
FIG. 7 is a perspective view of a printer with a cover removed showing the ribbon tensioning assembly.
Figure 8:
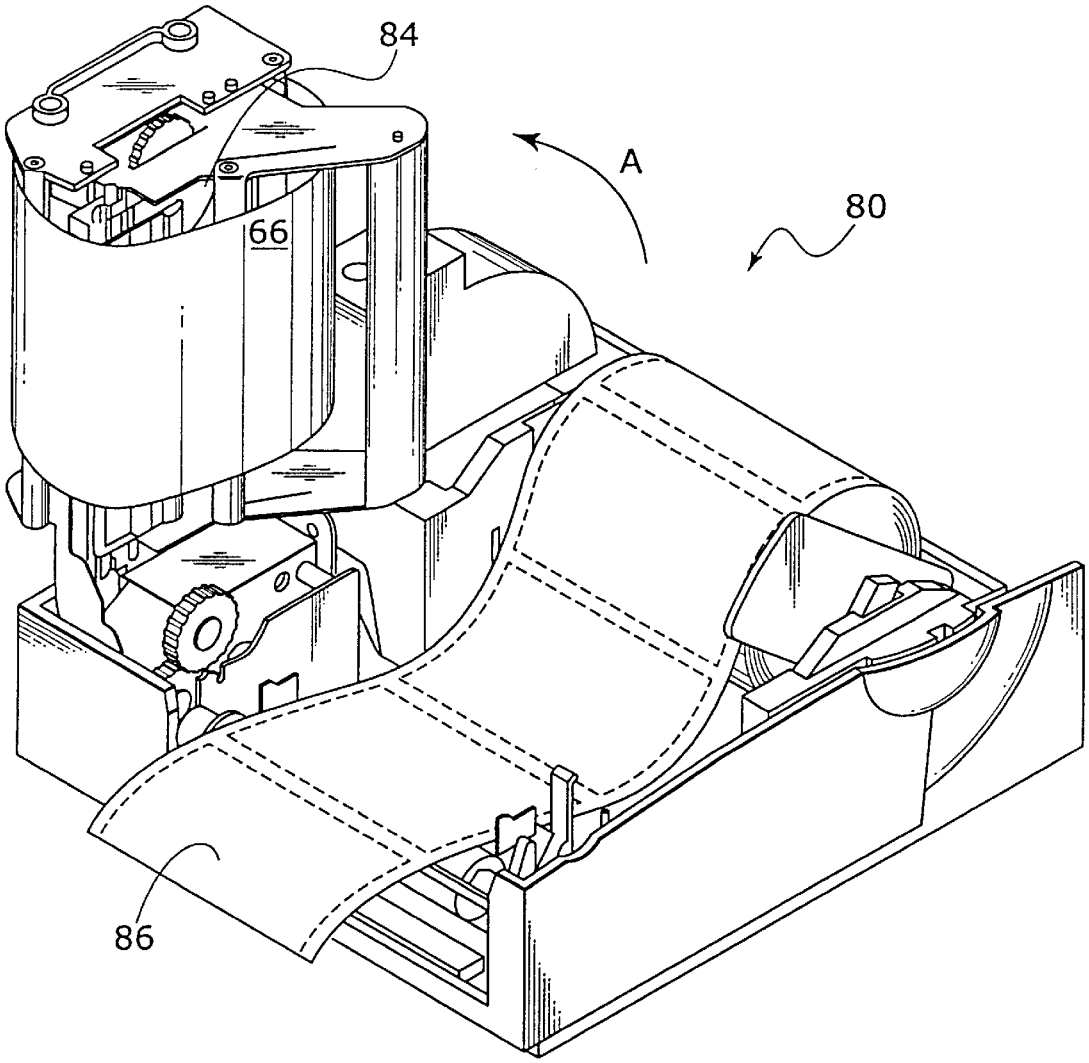
FIG. 8 is a perspective view of a printer head rotated upward showing the path of the ribbon.

Referring to FIGS. 7 and 8, ribbon tensioning assembly 10 is installed in a thermal printer 80. Supply roll 64 supplies ribbon 66 through a print head 84 where print is applied to a media 86. FIG. 8 shows print head 84 rotated upward in the direction of arrow "A" to better show ribbon 66 through the print area. Ribbon 66 is drawn through print head 84 and is tensioned by adjusting knob 44 to the appropriate level. Clockwise for less deflection of compression spring 40 and counterclockwise for higher deflection. Higher deflections correspond to higher frictional forces which should be used for wider ribbons. Lower deflections correspond with lower frictional forces which should be used for narrower ribbons. Ribbon 66 is used to print on print media 86 during operation and then stored on take up roll 82.

Having described preferred embodiments of a novel ribbon tensioning assembly (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as defined by the appended claims. Having thus described the invention with the details and particularity required by the patent laws, what is claimed and desired protected by Letters Patent is set forth in the appended claims.

What is claimed is:

1. A ribbon tensioning assembly comprising:

a spindle member having a first end portion and a second end portion, wherein said first end portion includes a flanged end;

a skewer for supporting a ribbon supply, said skewer engaging the first end portion of the spindle member; and a tension adjustment assembly mounted on the second end portion of the spindle member for selectively adjusting a tension applied to the ribbon supply during use thereof.

2. A ribbon tensioning assembly comprising:

a spindle member having a first end portion and a second end portion;

a skewer for supporting a ribbon supply, said skewer engaging the first end portion of the spindle member; and a tension adjustment assembly mounted on the second end portion of the spindle member for selectively adjusting a tension applied to the ribbon supply during use thereof, wherein the tension adjustment assembly comprises: a knob having a cavity therein; a compression assembly positioned at least partially within the cavity in the knob; and a spring engaging the compression assembly, the spring providing rotational tension against the compression assembly.

3. The ribbon tensioning assembly as recited in claim 2, wherein the knob includes at least one helical camming surface to facilitate adjustable tensioning of the spindle member.

4. The ribbon tensioning assembly as recited in claim 3, wherein the compression assembly includes a compression helix having at least one helical camming surface for engaging the at least one helical camming surface of the knob to facilitate adjustable tensioning of the spindle member.

5. The ribbon tensioning assembly as recited in claim 2, wherein adjustment of the knob varies an amount of rotational tension applied to the spindle member.

6. The ribbon tensioning assembly as recited in claim 2, wherein the compression assembly comprises a compression helix having a recessed portion therein; a compression spring having a first end and a second end, the first end being positioned at least partially within the recessed portion of the compression helix; a slip clutch washer positioned adjacent the second end of the compression spring; and a rewind disc positioned adjacent the slip clutch washer.

7. The ribbon tensioning assembly as recited in claim 6, wherein the rewind disc has a first surface end and a second flanged end, the first surface end positioned adjacent the slip clutch washer and the second flanged end engaging the spring.

8. The ribbon tensioning assembly as recited in claim 6, wherein the rewind disc is in a frictional rotational relationship with the slip clutch washer.

9. The ribbon tensioning assembly as recited in claim 2, wherein the ribbon tensioning assembly is used in a printing apparatus.

10. The ribbon tensioning assembly as recited in claim 2, wherein the ribbon supply is a roll of ribbon rotatably supported on the skewer.

11. A method of tensioning ribbon for a printer comprising the steps of:

providing a ribbon tensioning assembly comprising a spindle member having a first end portion and a second end portion, wherein said first end portion includes a flanged end;

a skewer for supporting a ribbon supply, said skewer engaging the first end portion of the spindle member; and a tension adjustment assembly mounted on the second end portion of the spindle member;

evaluating the ribbon supply to determine a desired amount of tension to be applied to the ribbon supply; and adjusting the tension adjustment assembly to provide the desired amount of tension on the ribbon supply.

12. A method of tensioning ribbon for a printer comprising the steps of:

providing a ribbon tensioning assembly comprising a spindle member having a first end portion and a second end portion;

a skewer for supporting a ribbon supply, said skewer engaging the first end portion of the spindle member; and a tension adjustment assembly mounted on the second end portion of the spindle member;

evaluating the ribbon supply to determine a desired amount of tension to be applied to the ribbon supply; and adjusting the tension adjustment assembly to provide the desired amount of tension on the ribbon supply, wherein the tension adjustment assembly comprises a knob having a cavity therein; a compression assembly positioned at least partially within the cavity in the knob; and a spring engaging the compression assembly, the spring providing rotational tension against the compression assembly; and the step of adjusting the tension adjustment assembly includes rotating the knob to vary the amount of rotational tension applied to the spindle member.

13. The method of tensioning ribbon for a printer as recited in claim 12, wherein the knob includes at least one helical camming surface; and the compression assembly includes a compression helix having at least one helical camming surface for engaging the at least one helical camming surface of the knob to facilitate adjustable tensioning of the spindle member.

14. The method of tensioning ribbon for a printer as recited in claim 12, further comprising the step of:

driving the ribbon supply such that the ribbon is tensioned by the tension adjustment assembly.

* * * * *